US006012433A

United States Patent [19]

Buescher

[11] Patent Number: 6,012,433

[45] Date of Patent: Jan. 11, 2000

[54] DIESEL INJECTOR MARKING SYSTEM

[76] Inventor: Alfred J. Buescher, 17001 Shaker Blvd., Shaker Heights, Ohio 44120

[21] Appl. No.: 09/137,032

[22] Filed: Aug. 20, 1998

[51] Int. Cl.[7] ..... F02M 37/04

[52] U.S. Cl. ..... 123/508; 29/888.011; 29/888.02

[58] Field of Search ..... 123/508, 509; 29/888.011, 888.02, 403.3, 426.3, 402.06; 239/600

[56] References Cited

U.S. PATENT DOCUMENTS

| | | | |
|---|---|---|---|
| 1,251,491 | 1/1918 | Ferriss . | |
| 1,467,961 | 9/1923 | Tibbetts . | |
| 1,477,466 | 12/1923 | Terhaar . | |
| 1,511,149 | 10/1924 | Trueblood . | |
| 1,901,989 | 3/1933 | Schwantes . | |
| 1,984,839 | 12/1934 | Murray . | |
| 4,527,738 | 7/1985 | Martin | 239/90 |
| 4,590,911 | 5/1986 | Sciotti et al. | 123/468 |
| 4,793,043 | 12/1988 | Mathews et al. | 29/402.06 |
| 5,467,924 | 11/1995 | Buescher | 239/88 |

*Primary Examiner*—Thomas N. Moulis

*Attorney, Agent, or Firm*—Pearne, Gordon, McCoy & Granger LLP

[57] ABSTRACT

In diesel engine fuel injectors of the unit injector type, indicia containing needed information are marked or incised on the working face of the follower which drives the pump plunger of the injector, the marking being done in such a way as not to unacceptably interfere with the normal operation of the follower.

10 Claims, 1 Drawing Sheet

FIG. 1
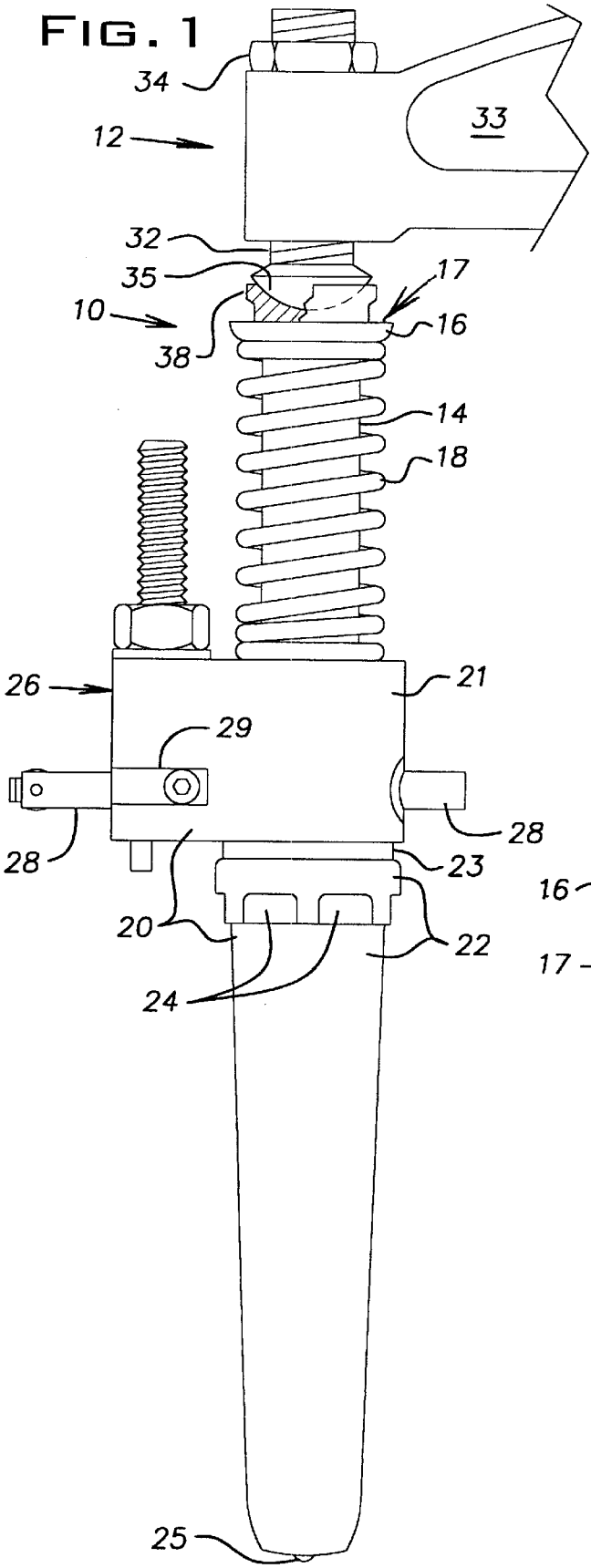
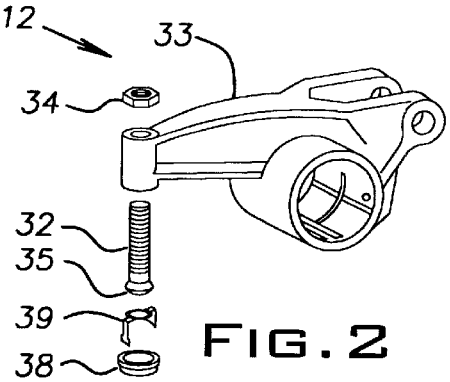
FIG. 2
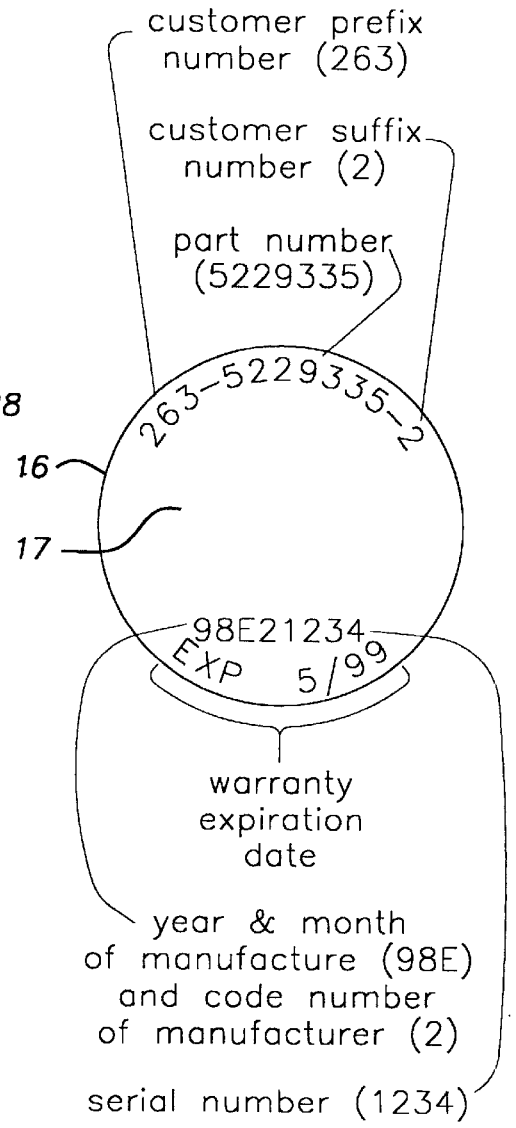
FIG. 3

DIESEL INJECTOR MARKING SYSTEM

This invention relates to diesel engine fuel injectors of the unit injector type, and particularly to mechanical unit injectors of such type that are characterized by a follower which drives the pump plunger on a feed stroke, and a return or follower spring which surrounds and is coaxial with the shank of the follower, bears on the underside of the follower head, and lifts or returns the follower and plunger on a return stroke. The invention is applicable, for example, to mechanical unit injectors of the sub-type known as EMD injectors, originally manufactured by Diesel Equipment Division of General Motors for Electro Motive Division of General Motors, but is not limited to that specific application.

BACKGROUND OF THE INVENTION

Mechanical diesel engine fuel injectors of the type to which the invention relates have a housing which may include a body assembly block in or to which other parts of the injector housing and various other elements of the unit injector are directly or indirectly mounted. Typically, the follower projects upward from the top of the injector body and has a working face at its top end. The injector housing may include an elongated hollow housing nut threaded on a boss extending from the bottom of the body assembly block. Mounted in the housing are the pump plunger, a bushing for the plunger, a check valve, and other elements. At the lower end is a spray tip. The housing nut may contain and clamp many of the housed elements in assembled stacked relation below the body assembly block.

Information pertaining to the fuel injector is marked on the flat front face of the body assembly block. The markings or indicia, usually in the form of alpha-numeric characters, are stamped on with individual steel dies (one for each character) that incise the characters into the face. The face is finished with a machined surface on which the incised characters are visible. The information can be stamped in ink, but ink markings are generally unsatisfactory because they can rub off or fade so that the information they contain is lost.

The stamped-on information includes information important to the long-term economic use of the injector. Such information includes information uniquely specific to the injector that is being marked, such as a unique serial number for each one of a series of injectors. (The same part number would apply to each member of the series, but each member would have its own unique serial number.) The information may include, directly or in coded key, manufacturer, year and month of manufacture, customer prefix and suffix numbers, part number, serial number, and warranty expiration date.

In many applications it is hard to see even the front face of an installed fuel injector, because the injector is installed in the engine cylinder head and the engine is installed in the engine compartment of a locomotive or other vehicle in such a way as to prevent directly observing the face. In order to obtain information marked on an injector, it may be necessary to remove the injector from the engine and then reinstall it again if its use is to be continued. Sometimes the marking can be read by using mirrors and lights, but that is also inconvenient and bothersome.

Injectors of the type to which the invention relates are remanufactured from time to time. This work may be done either by the original manufacturer or by other companies specializing in rebuilding. Railroads and truck lines, for example, have injectors rebuilt as a routine operating practice, just as truck lines have tires retreaded as a routine operating practice.

When an injector is remanufactured, the information to be marked on it must be updated. Generally, the available area for stamping information on the front face is limited, and the old information must be removed to make room for updated information, and also to eliminate any potential for confusion between old and new information. The practice is to machine or grind the flat front face to a depth sufficient to erase all the old markings and then stamp the new set of information items on the freshly exposed "new" surface of the front face. After this has been done several times, the body assembly block falls short of specified dimensional tolerances and must be replaced. Since the body assembly block is a major component of the overall injector assembly, the requirement that the block be replaced say every two or three rebuilding cycles represents a significant cost factor.

During operation of the injector, the upwardly-projecting follower is forced straight downward by a cam-driven rocker-arm linkage which engages the follower at the working face or top face of the follower. The follower spring returns the follower straight upward as permitted by the contour of the cam which drives the rocker arm. The rocker-arm element that engages the follower moves with a rocking motion rather than moving straight up and down. Therefore there is a slight relative sideways motion between the power output end of the rocker arm and the working face of the follower as the follower advances and returns.

This relative sideways motion is accommodated by a sliding action between the working face of the follower and the rocker-arm element that engages the follower face. Thus the parts transmit the high forces required to longitudinally advance the injector plunger while at the same time the part slide relative to each other along a direction transverse to tile longitudinal path of plunger advance. The working face is hardened by heat treating to better resist wear under the stressful conditions presented by such combination of high longitudinal force transmission and transverse relative sliding action.

In order to distribute and minimize compressive stresses and wear, the power output end of the rocker arm is provided with a ball-and-socket type swivel pad or shoe having a flat bottom face that is in face-to-face contact with the hardened working face of the follower. The flat face of the shoe slides back and forth sideways through a short distance across the flat working face of the follower as the rocker arm drives the follower downward and as the return spring lifts it upward. This face-to-face working contact avoids the occurrence of the extremely high local stresses that would be experienced if the contact between the working face of the follower and the element serving as the power output end of the rocker-arm linkage were point contact or line contact rather than face-to-face contact.

BRIEF DESCRIPTION OF THE INVENTION

The present invention involves the concept of marking or incising indicia on the working face of the injector follower in place of or in supplementation of marking the face of the injector body. This is done, however, in such a way as to avoid interfering or compromising the mechanical functioning of the parts at the interface between the follower working face and the face of the rocker-arm shoe (or any other element serving as the power output end of the rocker-arm linkage).

The invention reflects the insight that conventional preparation or finishing of the follower working face to prepare it for its mechanical functions inherently produces some "extra" or heretofore unused finished surface that can be utilized for marking, so that no special processing of the follower working surface is required to prepare it for markings. The machining or processing of the follower working face to prepare it for its mechanical functions can be according to established or prior practice, with no additional cost required to prepare the face for marking.

Regrinding or re-machining the working face to prepare it for remarking also accomplishes refinishing of the face in the remanufacturing process, thus accomplishing two functions in a single operation. The working face typically can be reground several times before the depth of case-hardening is exceeded, and the follower must be replaced. Replacement, when required, can be done for a small fraction of the cost of replacing a component such as the body assembly block 21, which is a much more expensive part.

From a method standpoint, the invention fits right into standard industry practices, regardless of how many times the injector has been previously remanufactured, or if it never has been remanufactured. The O.E.M. manufacturer can also practice the marking system without changing other manufacturing procedures, and at less cost than conventional marking.

By making recycling of unit injectors more efficient, the invention contributes to overall productivity and economic efficiency of the industry, as more fully discussed below.

BRIEF DESCRIPTION OF THE DRAWINGS

FIG. 1 is a side elevation of a mechanical unit injector and a fragmentary portion of an associated rocker-arm linkage, illustrating the environment of the invention, and the invention itself when taken together with the description below and the other drawings.

FIG. 2 is an isometric exploded view on a reduced scale showing more of the rocker-arm linkage seen in FIG. 1.

FIG. 3 is a view on a slightly larger scale than FIG. 1 showing the top face of one of the elements of FIG. 1 and illustrating the practice of the invention when taken together with the other drawings.

DETAILED DESCRIPTION OF THE INVENTION

Shown in the drawings is a mechanical diesel engine fuel injector generally indicated by the reference number 10. A rocker-arm linkage for powering the injection stroke of the injector 10 is generally indicated by the reference number 12, only one end of the rocker-arm linkage being seen in FIG. 1.

The housing 20 of the illustrated fuel injector includes a forged body assembly block 21 to which other parts of the injector housing and various other elements of the unit injector are directly or indirectly mounted. A follower projects upward from the top of the injector body and comprises a follower shank 14 and a follower head 16 of a greater diameter than the shank. The follower head has a working face 17 at its top side. The follower shank is mounted in the housing 20 for straight up and down rectilinear reciprocating motion along the length of the shank.

The injector housing may include an elongated hollow housing nut 22 threaded on a boss 23 formed at the bottom of the body assembly block 21. The nut is provided with wrench-receiving flats 24. Mounted in the housing are (not shown): the pump plunger, a bushing for the plunger, a check valve, an injection valve, and other elements. At the lower end is a spray tip 25. In a well known manner, the elongated housing nut 22 may contain and clamp many of the housed elements in assembled stacked relation below the body assembly block.

A return or compression spring 18 surrounds the follower shank 14. At its upper end, the spring directly or indirectly (via a washer, say) bears on the underside of the follower head 16 radially outward of the shank. The spring at its lower end directly or indirectly bears on the housing 20.

Associated with the rocker-arm linkage is a pusher stud 32 adjustably threaded to the outer end of the racker arm proper 33, and held in adjusted position by a locknut 34. A head 35 on the lower end of the pusher stud has a convex spherical bottom surface. This surface is congruently received against a corresponding concave surface of a shoe or pad 38, so that the head 35 and shoe 38 form a ball-and-socket joint. A clip or retainer spring 39 (shown in FIG. 2 only) may be provided to keep the shoe 38 on the head 35.

In this particular linkage, the shoe or pad 38 constitutes the power output end of the rocker-arm linkage 12. The working face 17 of the injector follower engages the bottom face of the shoe as the follower shank is driven straight down by the rocker-arm linkage during the downward half of the reciprocating motion of the shank, and also as the spring 18 raises the shank straight up and returns the rocker-arm linkage to its start-of-cycle position during the upward half of such reciprocating motion.

As it moves up and down, the pusher stud also moves back and forth transversely a sufficient distance to accommodate its swinging motion around the pivot center of the rocker arm proper 33. Such transverse motion of the pusher stud causes a corresponding back-and-forth sliding contact between the bottom face of the shoe 38 and the working face 17 of the follower. This sliding contact occurs throughout an area which covers central portions of the total area of the working face 17 and occurs simultaneously with the transmission of high compressive forces between the output end of the rocker-arm linkage and the working face 17.

The output end of the rocker-arm linkage includes the pad or shoe 38 for distributing the compressive stresses at the working face 17, but could (far less desirably from a standpoint of stress and wear) comprise merely an output element with non-pad contact such as the head 35 of the pusher stud itself (perhaps having a cylindrically-shaped bottom face rather than a spherically-shaped one) which would still generate an area of sliding contact between the working face of the injector's follower and the (non-padded) output element of the rocker-arm linkage.

As indicated in the above background discussion, the practice in the art has been to mark the front face of the housing with information that is important to the long-term economic use of the injector. Thus it is conventional practice to stamp such information on front of the unit, such as on the flat front face 26 of the forged body assembly block 21 in the EMD-type (subtype of mechanical unit injector) illustrated in the drawings. The stamping is done with steel dies which incise the information into the front face, using an individual die for each character. The face is finished as a machined surface on which the stamped information is visible.

In conventional practice, when the injector is remanufactured and the information marked on the front of the injector (e.g. on the front face 26 of an EMD-type injector) must be updated, the face is machined or ground to a depth sufficient to erase all the old markings. A new set of information is then die-stamped on the freshly exposed "new" surface of the face. After this has been done a few times, the body assembly block or similar housing element falls short of dimensional specifications and must be replaced.

In the EMD-type injector, in particular, grinding the marked front face of the housing has another disadvantage. As is well known, the proportion of each stroke of the injector plunger (not shown) during which feed occurs is changed by rotating the plunger on its axis to different angular positions relative to the plunger bushing (not shown). For this purpose, a pinion gear (not shown) surrounds and is rotatively keyed to the plunger. The pinion gear is engaged and driven by a rack 28, which as suggested by the illustration in FIG. 1, may be slidably mounted for horizontal movement back and forth through the injector body assembly block. The rack extends into or through the body assembly block and moves perpendicularly past (through) the front face 26. A calibrating slide 29 is mounted on the body assembly block adjacent the rack for adjusting injector output on a calibrating stand. The calibrating slide is not intended for field use, but only for use on a calibrating stand. Limits in the order of several hundredths of an inch, say 0.03 inch, are established as to the maximum distance from an end of the calibrating slide 29 to the front face 26 of the body assembly block 21. This specification is affected by the grinding of the front face 26, which must be taken into account when injector output of a remanufactured injector is adjusted on a calibrating stand. This is a further disadvantage of the marking practice of the prior art.

According to the present invention, the front face of the housing is not marked with information, or is marked only with information that is never required to be changed. Instead, indicia carrying the required information is incised on the working face 17 of the follower in place of or in supplementation of marking the front face.

The markings are located on the working face 17 generally in the vicinity of the periphery of the follower head 16 and outside the area of sliding contact between the working face and the shoe or pad 38 (or between the working face and any element that is the output element associated with the output end of the rocker-arm linkage, as for example the head 35 of the pusher stud 32 if the shoe 38 is omitted from the linkage). The markings may project slightly into the area of sliding contact between the parts to an extent not inconsistent with acceptable wear and operating performance, so long as the obscuring of some portions of one or more characters is acceptable, which may be the case for example where the obscured portion on any alphameric character that might be used will be small enough so that the identity of the character is still determinable without ambiguity. Preferably the markings are located entirely outside the area of sliding contact. Less preferably, as to each character carrying needed information, enough of the character is outside such area as to constitute an unambiguously intelligible part of the character.

As used in this disclosure, the term "incise" includes marking by removing or deforming metal. Any suitable method of incising may be employed. Presently preferred practice is to incise markings by using a PC-controlled "pin marker." PC-controlled pin markers are well known for use in incising metal surfaces with text and other indicia. The visibility of the characters incised by pin marker on the finished working face of the follower is good.

Marking may be done by other marking systems, including laser systems, electrochemical and chemical etching, "electric pencils" (using an electric arc to remove or deform metal), stamping dies adapted to automatically index from one serial number to the next, or simply stamping dies individually manually applied to a series of injectors in different combinations so as to mark a unique serial number on each member of the series.

Typical information included in the marking of a remanufactured injector is illustrated in FIG. 3. The legends in the drawing explain the meaning of the various characters. D The "manufacturer" referred to in one of the legends is the company performing the rebuilding of the injector.

The marking is usually conveniently accessible to direct line-of-sight viewing without mirrors even when the injector and associated rocker-arm linkage are installed on an engine located within the engine compartment of a locomotive or other vehicle or vessel. This convenient accessibility contrasts with the relatively inconvenient accessibility of conventional marking located for example on the front face 26. The marking on the working face 17 is preferably oriented so that the bottoms of the marked characters are toward the front of the injector, that is, are toward the front face 26 of the body assembly block 21 in the illustrated apparatus.

In one aspect, the invention embodies the concept of increasing the potential for future recycling of an individual injector by delaying the future necessity for replacing the costliest parts of the injector, as for example the body assembly block. Long-term productivity and economic efficiency of the unit injector industry is thereby significantly improved, all by simply including in the remanufacturing process the step of removing markings that require updating and replacing them with updated information incised on the working face of the follower as described.

Delaying the future necessity for replacing the costliest parts of the injector is not the only way in which the invention enhances long-term productivity and efficiency. The invention, also makes future recycling more efficient by allowing regrinding of a working surface and removal of obsolete markings to be accomplished in a single step in such future recycling. Rebuilding almost always necessarily involves removal of material from the working face 17 incident to refinishing (regrinding) it to remove wear spots. In the practice of the invention, such removal in a future recycling will also accomplish removal of then-old indicia incised into the working face of the follower in a previous rebuilding according to the invention. One regrinding will therefore accomplish two functions that theretofore were required to be accomplished entirely separately — refinishing of a working surface and removal of old information pertaining to the injector as a whole.

It should be evident that this disclosure is by way of example, and that various changes may be made by adding, modifying or eliminating details without departing from the fair scope of the teaching contained in this disclosure. The invention therefore is not limited to particular details of this disclosure except to the extend that the following claims are necessarily so limited.

What is claimed is:

1. A diesel engine fuel injector, a rocker-arm linkage for powering the injection stroke of said fuel injector, said fuel injector having a housing, a follower shank projecting from the top of the housing, said follower shank being mounted in the housing for straight up and down rectilinear reciprocating motion along the shank's length, a follower head at the top end of the shank, the head having a greater diameter than the shank, a compression spring surrounding the follower shank, the spring directly or indirectly bearing on the underside of the head radially outward of the shank, the spring also directly or indirectly bearing on the housing, the follower head having a finished working face at the head's top side adapted to be in engagement with an output element associated with the power output end of said rocker-arm linkage as the shank is driven straight down by said linkage during the downward half of said reciprocating motion and as said spring raises said shank straight up and returns said linkage to its start-of-cycle position during the upward half of said reciprocating motion, said engagement between and said power output end of a rocker-arm linkage and said working face being accompanied by sliding contact between the said linkage end and said working face throughout an area of sliding contact covering central portions of the area of said working face while compressive forces are transmitted between said linkage end and said working face, and indicia incised on said finished working face of said follower head at portions of the area of said working face that are outside said area of sliding contact, said indicia marking said injector with information that will not rub off when the injector is in use or otherwise subject to wear or exposure.

2. A device as in claim 1, said indicia being incised on said finished working face of said follower head in the vicinity of the periphery of said follower head.

3. A device as in claim 1, wherein at least an unambiguously intelligible part of each character that is included in said indicia and that carries needed information is located on said working face outside said area of sliding contact.

4. A device as in claim 1, said incisions being pin marker incisions.

5. A device as in claim 1 wherein at least portions of characters that are included in said indicia are located on said working face outside the periphery of said shank.

6. In a diesel engine fuel injector having a housing, a follower shank projecting from the top of the housing, said follower shank being mounted in the housing for straight up and down rectilinear reciprocating motion along the stank's length, a follower head at the top end of the shank, the head having a greater diameter than the shank, a compression spring surrounding the follower shank, the spring directly or indirectly bearing on the underside of the head radially outward of the shank, the spring also directly or indirectly bearing on the housing, the follower head having a finished working face at the head's top side adapted to be in engagement with an output element associated with the power output end of a rocker-arm linkage as the shank is driven straight down by said linkage during the downward half of said reciprocating motion and as said spring raises said shank straight up and returns said linkage to its start-of-cycle position during the upward half of said reciprocating motion, said engagement between and said power output end of a rocker-arm linkage and said working face being accompanied by sliding contact between the said linkage end and said working face throughout an area of sliding contact covering central portions of the area of said working face while compressive forces are transmitted between said linkage end and said working face, the improvement wherein indicia for marking said injector with information that will not rub off when the injector is in use or otherwise subject to wear or exposure are incised on said finished working face of said follower at portions of the area of said working face that are outside said area of sliding contact.

7. A device as in claim 6, said indicia including indicia incised in the vicinity of the periphery of said head.

8. A method of rebuilding and marking a series of diesel engine fuel injectors each having a housing, a follower shank projecting from the top of the housing, said follower shank being mounted in the housing for straight up and down rectilinear reciprocating motion along the shank's length, a follower head at the top end of the shank, the head having a greater diameter than the shank, a compression spring surrounding the follower shank, the spring directly or indirectly bearing on the underside of the head radially outward of the shank, the spring also directly or indirectly bearing on the housing, the follower head having a finished working face at the head's top side adapted to be in engagement with an output element associated with the power output end of a rocker-arm linkage as the shank is driven straight down by said linkage during the downward half of said reciprocating motion and as said spring raises said shank straight up and returns said linkage to its start-of-cycle position during the upward half of said reciprocating motion, said engagement between and said power output end of a rocker-arm linkage and said working face being accompanied by sliding contact between the said linkage end and said working face throughout an area of sliding contact covering central portions of the area of said working face while compressive forces are transmitted between said linkage end and said working face, said method comprising a set of steps for each injector in said series, the set of steps for each injector in said series comprising:

finishing the said working face of a cam follower head to be associated with said injector, assembling the parts of said injector, said parts including said cam follower head having said finished working face, to provide an assembled injector in said series of injectors with said cam follower head associated therewith and forming part of said assembly, and incising indicia on said finished working face of said cam follower head after said step of finishing and prior to said step of assembling to thereby provide marking to uniquely identify said injector.

9. A method as in claim 8, said step of finishing the said working face of a cam follower head for each injector in said series comprising a refinishing step, said refinishing step being preceded by the step of grinding material from said working face to smooth worn spots.

10. A method as in claim 9, said grinding step simultaneously also removing previously existing markings from said working face while smoothing worn spots, and in said step of incising indicia on said finished working face, said indicia are incised in areas of said face outside the areas of said removed worn spots.

* * * * *

UNITED STATES PATENT AND TRADEMARK OFFICE

CERTIFICATE OF CORRECTION

PATENT NO. : 6,012,433
DATED : January 11, 2000
INVENTOR(S) : Alfred J. Buescher It is certified that error appears in the above-indentified patent and that said Letters Patent is hereby corrected as shown below:

Column 2, line 33 "part" should be --parts--.

Column 4, line 11 "racker" should be --rocker--.

Column 6, line 6 delete "D".

Column 6, line 33 "invention," should be --invention--.

Column 7, line 34, claim 6 "stank's" should be --shank's--.

Signed and Sealed this

Fifth Day of September, 2000

*Attest:*

*Attesting Officer*

Q. TODD DICKINSON

*Director of Patents and Trademarks*